United States Patent [19]

Harrison

[11] 4,433,940

[45] Feb. 28, 1984

[54] TETHERED SUBMARINE PRESSURE TRANSFER STORAGE FACILITY FOR LIQUIFIED ENERGY GASES

[75] Inventor: David B. Harrison, San Mateo, Calif.

[73] Assignee: Cook Stolowitz & Frame, Visalia, Calif.

[21] Appl. No.: 321,385

[22] Filed: Nov. 16, 1981

[51] Int. Cl.[3] ..... E02D 27/38

[52] U.S. Cl. ..... 405/210; 405/52

[58] Field of Search ..... 405/210, 52; 114/256, 114/257; 220/85 A, 85 B

[56] References Cited

U.S. PATENT DOCUMENTS

| | | | |
|---|---|---|---|
| 3,146,458 | 8/1964 | Estes et al. | 114/257 |
| 3,727,418 | 4/1973 | Glazier | 405/210 |
| 3,898,846 | 8/1975 | McCabe | 405/210 |
| 4,043,352 | 8/1977 | Simpson | 220/85 B |
| 4,190,072 | 2/1980 | Fernandez et al. | 405/210 |
| 4,209,271 | 6/1980 | McCabe et al. | 405/210 |
| 4,232,983 | 11/1980 | Cook et al. | 405/210 |
| 4,365,576 | 12/1982 | Cook | 405/210 |

FOREIGN PATENT DOCUMENTS

| | | | |
|---|---|---|---|
| 1442179 | 7/1976 | United Kingdom | 405/210 |

*Primary Examiner*—Dennis L. Taylor
*Assistant Examiner*—John A. Gungor
*Attorney, Agent, or Firm*—David B. Harrison

[57] ABSTRACT

An improved offshore submarine storage facility in the ocean and like water bodies for storing liquified energy gases and similar liquid materials under pressure and at cryogenic temperatures is disclosed. The facility includes a two-part insulated submarine storage tank positioned at a selected depth in the water for storing said materials, wherein the two parts thereof move in a slidably sealing engagement relative to each other to form an insulated compression storage chamber. The tank also includes ambient water pressure transfer means for transferring external ambient water pressure to the materials stored therein. Mechanical pressure transfer devices increase the pressure applied to the materials stored therein to achieve a total pressure which promotes and aids maintenance of liquid state of the stored cryogenic materials. The tank further includes an extensible, seawater impermeable membrane extending between said two parts to form an enclosed space to seal off seawater from surfaces of said parts which slide relative to each other in sealing engagement. A balancing fluid is disposed in said enclosed space at a pressure equalized with ambient seawater pressure for providing further thermal insulation and for isolating the sealing surfaces from contact by seawater throughout the range of slide movement of the two parts of the storage tank. A balancing fluid recirculation jacket surrounding the tank provides another aspect of the present invention.

8 Claims, 3 Drawing Figures

TETHERED SUBMARINE PRESSURE TRANSFER STORAGE FACILITY FOR LIQUIFIED ENERGY GASES

BACKGROUND OF THE INVENTION

The present invention relates to storage facilities for highly chilled liquified gases. More particularly, this invention relates to tethered submarine pressure transfer storage facilities for materials such as liquified natural gas (LNG).

It has been long known to liquify gases, including natural gas (methane), to reduce volume thereof and thereby facilitate transportation and storage. A significant drawback stemming from the liquifaction process is the vastly increased concentration of energy producing material with resultant substantial dangers and hazards to the immediate environment of such liquified materials.

Natural gas is a mixture of hydrocarbons, typically 65 to 90 percent methane, with smaller amounts of ethane, propane and butane. When natural gas is chilled to the below minus 263 degrees Fahrenheit, it becomes an odorless, colorless liquid having a volume which is less than one six hundredth (1/600) of its volume at ambient atmospheric surface temperature and pressure. When LNG is warmed above its −263 degrees Fahrenheit boiling point, it regassifies and expands to its ambient volume.

Of the known liquid energy gases, LNG is the most difficult to handle because it is so intensely cold relative to the general environment at sea level. Complex handling, shipping and storage facilities and procedures are required to prevent unwanted thermal rise in the stored LNG and resultant regassification.

The Pognowski U.S. Pat. No. 3,643,447 teaches a tethered flexible storage container for storing crude oil and the like in the ocean beneath an offshore drilling platform. It was intended to store petroleum materials at ambient seawater, and therefore does not relate to storage of highly chilled materials such as LNG. On the other hand, the Glazier U.S. Pat. No. 3,727,418 describes an insulated spherical storage vessel for LNG materials under water. Pressure transfer is not suggested in the Glazier patent, although a flexible membrane and a balancing fluid of 2-methyl butane (ethyldimethylmethane) are disclosed.

It is known in the art that the addition of pressure to stored LNG raises the boiling point and helps to promote liquid state thereof. The assignee of the present invention is the owner of the Cook and Stolowitz U.S. Pat. No. 4,232,983 which teaches the use of a submerged pressure transfer storage facility for LNG. The assignee of the present invention is the owner of two pending patent applications by Cook, Ser. No. 170,800 filed July 21, 1980, now U.S. Pat. No. 4,365,576, and Ser. No. 180,607 filed Aug. 25, 1980, now U.S. Pat. No. 4,402,632. Each of these references teaches various facets of deep seawater pressure transfer to stored LNG to promote and maintain liquid state. The present invention overcomes several significant difficulties encountered with these prior references and constitutes an improvement on the technology thereof.

One drawback of the prior art submarine pressure transfer storage facilities described above was the direct contact of seawater and marine life to the seal providing surfaces of those two part pressure transfer vehicles. Another drawback was the depth required to provide sufficient pressure transfer to promote liquid state of the LNG material stored therein (about 600 or more feet of water depth). Another drawback was the complex ballasting equipment needed for operating those facilities. One more drawback was the direct contact of seawater at the seal-providing region of the tank and the problem of preventing formation of ice at the seal, thereby impeding the pressure transfer function.

SUMMARY OF THE PRESENT INVENTION

A general object of the present invention is to provide a submarine pressure transfer storage facility for LNG and the like which is tethered at a selected depth in a body of offshore water such as the ocean or great lakes and which overcomes drawbacks of prior pressure transfer storage facilities.

Another object of the present invention is to provide a simplified submarine pressure transfer storage facility in which seal forming surfaces are isolated from ambient seawater by an envelope formed with a flexibly extensive membrane and a circulating thermally insulating balancing fluid.

A further object of the present invention is to provide a simplified submarine two part pressure transfer storage vessel in which mechanical force is applied between the two parts to contribute to the force of ambient seawater applied thereto, so that liquid state of the LNG may be promoted by controlling the quantum of pressure applied thereto.

One more object of the present invention is to provide a circulating jacket around the interior of a submarine storage vessel which jacket contains a chilled circulating balancing fluid so that further insulation may be promoted by the balancing fluid as a further mechanism to promote and maintain liquid state of the stored contents.

The foregoing objects are achieved in an improved offshore submarine storage facility tethered to the floor of the ocean or other large water body and for storage of liquified energy gases and other liquid materials at cryogenic temperatures. The facility includes a two part insulated submarine storage tank positioned at a selected depth in the water which defines an interior volume for storage of the liquid material. The two parts of the tank move relatively to each other in a slideably sealing engagement so that the interior volume tends to become reduced as the two parts move together and thereby apply pressure. The two parts have major surfaces which are exposed to ambient sea water pressure in a way which transfers such pressure to the materials stored within the interior volume. The two parts also have mechanical pressure transfer equipment by which even more pressure may be transferred in a controlled amount to the materials stored within the interior volume. A flexibly extensible, sea water impermeable membrane continuously extends from one of the parts to the other of the parts of the tank to define an enclosed envelope adjacent to the sealing surfaces of the two parts, and a circulating balancing fluid is located in the envelope to provide further thermal insulation and to transfer sea water pressure to the two parts. It also serves as a lubricant at the seal engagement of the two parts. Another aspect of the present invention is the provision of a jacket tank containing balancing fluid around the exterior of the two part tank. The balancing fluid is introduced at the top of the tank at ambient sea water temperatures and recirculates to maintain its liquid state and to reduce formation of any ice at the seal providing region of the tank where the problems otherwise occasioned by the extreme thermal gradient are greatest.

These and other objects, advantages and features of the present invention will be apparent from the following description and claims and are illustrated in the accompanying drawings which, by way of illustration, show preferred embodiments of the present invention and the principles thereof and what are now considered the best modes contemplated for these principles. Other embodiments of the invention embodying the same or equivalent principles may be used and structural changes may be made as are desired by those skilled in the art without departing from the present invention and the purview of the appended claims.

DETAILED DESCRIPTION OF A PREFERRED EMBODIMENT

Figure 1:
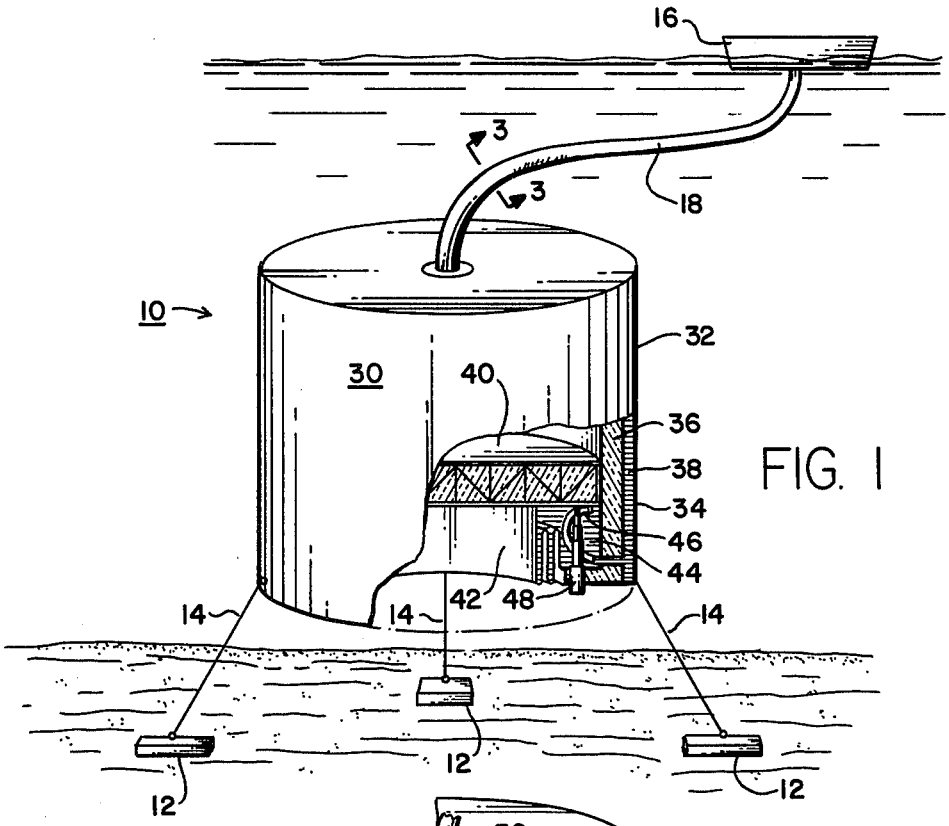
FIG. 1 is a somewhat diagrammatic view in perspective of a tethered submarine pressure transfer storage facility for highly chilled liquid materials in accordance with the principles of the present invention, a front lower right portion thereof being broken away and diametrally sectioned to facilitate illustration and understanding thereof.

A submarine storage facility 10 in accordance with the principles of the present invention is shown diagramatically in its intended sea water submerged operating environment in FIG. 1. The facility 10 is tethered to plural anchors 12 on the floor of the ocean or other suitably deep water body by steel cables 14 which are coated to resist corrosion. A floating control platform 16 contains liquification and refrigeration equipment, control heads and crew quarters. It also contains loading and unloading gantries and piping for LNG transport vessels which anchor alongside it. The platform 16 is laterally offset away from the underwater facility 10 a safe distance so that any escaping LNG will not come up directly under the platform 16.

A semiflexible umbilical conduit 18 provides a physical connection and passageway between the underwater facility 10 and the floating control platform 16. The conduit 18 is described in greater detail in connection with FIG. 3 hereinafter.

The facility 10 is anchored at a depth in the water selected to provide a substantial amount of pressure transfer to stored LNG material. The particular depth selected will depend upon total available depth at the storage site, the amount of mechanical pressure transfer needed to promote liquid state of the stored material and the size of the storage vessel. One advantage of storage of LNG at considerable depths in the ocean is the dissipation over a substantial surface area of small leaks of LNG. The closer to the surface, the less dispersal of such leaks. Another consideration is the maintenance of the facility 10. The deeper the facility, the more costly is maintenance. A depth of from 100 to 500 feet is preferred. Raising the facility 10 to the surface in inverted orientation is taught by the assignee's commonly owned U.S. patent application, Ser. No. 130,607, now U.S. Pat. No. 4,402,632.

The facility 10 includes a two part pressure transfer storage vessel 30 comprising a top-capped cylinder 32 having an outer wall 34 having a coated metal skin, interior reinforcing structure and insulation 36 such as perlite or equivalent. An inner wall structure 38 defines a jacket or cylindrical tank structure for balancing fluid next to an interior wall or skin. The interior wall structure is made of thin but strong sheets of metal which will withstand the stresses induced by the severe thermal gradient posed by the liquified LNG stored therein. The inner wall structure may be as described in U.S. Pat. No. 4,232,983, commonly owned with the present application, to which reference has already been made.

Between the outer wall structure 34 of the cylinder 32 and the insulated tank interior structure 36 a cylindrical balancing fluid storage and circulation chamber is provided which essentially surrounds the entire outer wall structure 38. The chamber contains an organic balancing fluid which is introduced at the top of the cylinder 32 from the conduit 18 and which circulates over the entire surface of the storage vessel 30. The balancing fluid is an organic liquid preferably of low to moderate molecular weight which has the characteristics of liquidity at both ambient and cryogenic temperatures. There are several alkanes which may be used, although this is not meant to be limiting to alkanes only. The Glazier U.S. Patent teaches the use of 2-methyl butane as a balancing fluid, for example.

The second part of the two part storage vessel 30 comprises an insulated and reinforced cylindrical piston 40 which slides up and down within the cylinder 32. the piston 40 includes an inner, LNG contacting surface, and an outer, seawater contacting surface. Insulation, such as perlite or equivalent, and suitable reinforcing structure are disposed between the two surfaces thereof to provide structural integrity as well as to handle the severe thermal gradient. The piston may be of the type described in the copending U.S. patent application Ser. No. 180,607, now U.S. Pat. No. 4,402,607 and it may be provided with peripheral seals as described in the copending U.S. patent application Ser. No. 170,800, now U.S. Pat. No. 4,365,576 applications commonly owned with the present application.

A flexibly extensive, reinforced rubber membrane 42 in the form of a generally cylindrical gasket is secured at one end to the outer surface of the piston 40 and at the other end to the periphery of an inwardly extending flange portion at the bottom of the cylinder 32. The membrane 42 is shown in its collapsed state in FIG. 1 with the piston fully extended to the bottom of the cylinder, and it is shown in its taut, extended state in FIG. 2 wherein the piston 40 is retracted to the top of the cylinder 32. The membrane 42 may be formed of neoprene with internal steel cables disposed for reinforcement, as disclosed and taught by the Pognowski U.S. Pat. No. 3,643,447, already discussed herein.

Figure 2:
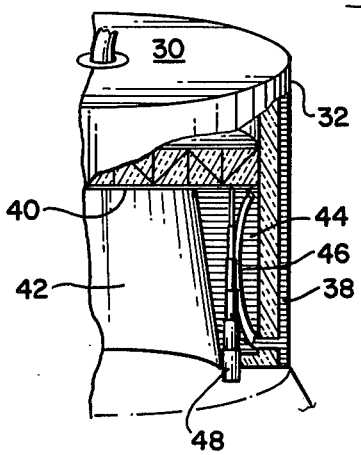
FIG. 2 is another diagrammatic view in perspective of a right side portion of the submarine pressure transfer storage vessel with a substantial portion thereof being broken away and internal components diametrally sectioned.

The membrane 42 defines as interior annular space 44 which is filled with balancing fluid from the inner jacket 38 which passes into the space 44 via a flexible connecting hose 46 having an end secured to the bottom of the piston 40 adjacent the sealing region. Although only one hose is depicted, many are provided, and pumps (not shown) cause balancing fluid at seawater temperature to be discharged at the viscinity of the seal. In this way ice formation at the seal is precluded. The balancing fluid will have passed adjacently of most of the exterior storage surface of the cylinder 32 and will have become warmer and more fluid by the time it reaches the space 44 where it functions as a further insulator and as a lubricant for the seals at the periphery of the piston 40. Also, the balancing fluid within the space 44 prevents any contact of salt water or other corrosive or contaminating agents (such as marine life and the like) with the inner-seal-providing wall of the cylinder 32. As the piston 40 rises in the cylinder 32 during unloading of the vessel 30, additional balancing fluid is introduced into the space 44, as shown in FIG. 2. It will be apparent from inspection of the drawings that the balancing fluid within the space 44 is at the same pressure as the ambient sea water. This pressure may be provided by pumps at the facility 30 or on the floating control platform 16.

A plurality of telescoping hydraulic rams 48 are disposed in the annular flange at the base of the cylinder 32, and they drivingly connect to the bottom of the piston 40, within the space 44 occupied by the lubricating balancing fluid. The rams 48 are connected in series to exert equal force on the piston 40 and to drive it upwardly to apply pressure to the stored LNG (in addition to ambient sea water pressure) to promote liquid state. The size of the rams 48 depends on the depth at which the facility 10 is tethered. For example, at a depth of approximately 600 feet sufficient ambient pressure is available to provide sufficient pressure to keep the LNG contents in a liquid state over a substantial thermal gradient. As the depth is decreased, so is the ambient pressure, and this difference must be made up by the rams 48 to achieve the same pressure transfer. Control equipment for the hydraulics is provided on the control platform 16.

Figure 3:
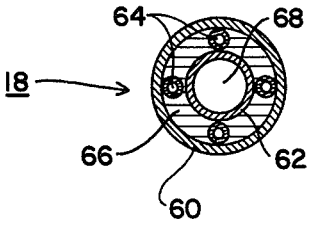
FIG. 3 is a sectional view of a semiflexible umbilical conduit extending from the vessel to a floating surface control platform, taken along the line 3—3 in FIG. 1.

Referring to FIG. 3, the umbilical conduit 18 is seen to include a plurality of passages. An outer reinforced sheath 60 surrounds an inner coaxial conduit member 62. The inner member 62 has a central passage for LNG, and it is separated from the outer member 60 by a plurality of smaller conduits 64 which define interior passages for control cables, hydraulics, etc. Passages are also defined between the inner and outer members 62 and 64, and these are used for transfer of balancing fluid to and from the vessel 30. Highly chilled LNG and balancing fluid pass down to the tank 30, and the balancing fluid enters and circulates through the interior jacket 38 until it finally reaches the space 44 closed off from the sea by the membrane 42. The balancing fluid is collected at a location in that space and is passed back up to and through the conduit 18 via one or more of the passages 66 to the control platfrom, as needed.

To those skilled in the art to which this invention applies, the achievement of an improved submarine pressure transfer storage facility for liquified energy gases will appreciated. Many changes in construction and widely differing embodiments and applications of the invention will suggest themselves without departing from the spirit and scope of this invention. The disclosures and the description herein are purely illustrative and are not intended to be in any sense limiting.

I claim:

1. An improved offshore submarine storage facility in the ocean and like water bodies for storing liquified energy gases and similar liquid materials under pressure and at cryogenic temperatures, said facility comprising:

two-part insulated submarine storage tank means positionable at selected depth in the water for storing said materials, wherein the two parts thereof move in a slidably sealing engagement relative to each other to form an insulated compression storage chamber, said tank means including ambient water pressure transfer means for transferring external ambient water pressure at said selected depth to said materials stored therein, said facility further including pressure transfer means for increasing pressure applied to said materials stored in said tank means to achieve a total pressure which promotes and aids maintenance of liquid state of said materials, said tank means further including an extensible, seawater impermeable membrane extending between said two parts to form an enclosed space to seal off seawater from surfaces of said parts which slide relative to each other in sealing engagement, and, balancing fluid means in said enclosed space at a pressure equalized with ambient seawater pressure for providing further thermal insulation and for isolating said surfaces from contact by seawater throughout the range of slide movement of said two parts.

2. The facility set forth in claim 1 further comprising a floating control platform at the surface of said water body and anchored laterally adjacent said submarine tank means, and semiflexible conduit means extending between said tank means and said floating control platform, for transfer of said material to and from said tank means from said water body surface.

3. The facility set forth in claim 1 further comprising insulating jacket means adjacently surrounding the exterior of said two part tank means and filled with circulating liquid balancing fluid means for providing further insulation between said stored materials and the ambient water.

4. The facility set forth in claim 3 further comprising connection means for connecting said insulating jacket means with said enclosed space, thereby facilitating circulation of balancing fluid initially introduced to said facility at said jacket means into said space defined between said membrane means and said sealing surfaces of said parts, and further comprising means for recirculating said balancing fluid to promote and maintain liquid state thereof.

5. The facility set forth in claim 1 wherein said pressure transfer means comprises a plurality of hydraulic ram means disposed within said space defined between said membrane means and said sealing surfaces and drivingly connected between said two parts of said tank means for increasing pressure applied to said stored materials.

6. The facility set forth in claim 2 wherein said conduit means comprises a coaxial conduit including a central axial component for passing liquified material at cryogenic temperature to and from said tank means, and an outer insulating sheath, with interior structure between said sheath and said central component defining a plurality of additional passages for passing balancing fluid to and from said tank.

7. The facility set forth in claim 1 wherein said one of said two parts of said tank means comprises a cylinder having a closed top and a downwardly extending cylindrical sidewall, and said other of said two parts comprises a cylindrical piston slideably disposed inside said cylinder, said cylinder having an inwardly extending flange at the lower, open periphery thereof, said membrane means comprising a generally cylindrical flexible reinforced flexible gasket sealed at one periphery to said flange and at its other periphery to the outer surface of said piston and adapted to extend and close off said inside of said cylinder throughout the range of slide movement of said piston thereby defining said enclosed space, and wherein said mechanical pressure transfer means is disposed within said enclosed space.

8. An improved offshore submarine storage facility in the ocean and like water bodies for storing liquified energy gases and similar liquid materials under pressure and at cryogenic temperatures, said facility comprising:

two-part insulated submarine storage tank means tethered at a selected depth in the water for storing said materials, wherein the two parts thereof move in a slidably sealing engagement relative to each other to form an insulated compression storage chamber, said tank means including ambient water pressure transfer means for transferring external ambient water pressure to said materials stored therein, said tank means further including mechanical pressure transfer means for increasing the pressure applied to said materials stored therein to achieve a total pressure which promotes and aids maintenance of liquid state of said materials, said tank means further including an extensible, seawater impermeable membrane extending between said two parts to form an enclosed space to seal off seawater from surfaces of said parts which slide relative to each other in sealing engagement, and, balancing fluid means in said enclosed space at a pressure equalized with ambient seawater pressure for providing further thermal insulation and for isolating said surfaces from contact by seawater throughout the range of slide movement of said two parts.

* * * * *